US007433482B2

(12) United States Patent
Wehner

(10) Patent No.: US 7,433,482 B2
(45) Date of Patent: Oct. 7, 2008

(54) MICROPHONE IN A CYLINDRICAL HOUSING HAVING ELLIPTICAL END FACES

(76) Inventor: Raymond Wehner, 241 Eveline St., Selkirk, Manitoba (CA) R1A 1L7

( * ) Notice: Subject to any disclaimer, the term of this patent is extended or adjusted under 35 U.S.C. 154(b) by 673 days.

(21) Appl. No.: 10/532,230

(22) PCT Filed: Oct. 30, 2003

(86) PCT No.: PCT/CA03/01632

§ 371 (c)(1),
(2), (4) Date: Apr. 22, 2005

(87) PCT Pub. No.: WO2004/040940

PCT Pub. Date: May 13, 2004

(65) Prior Publication Data

US 2006/0050916 A1 Mar. 9, 2006

(30) Foreign Application Priority Data

Oct. 31, 2002 (CA) ..... 2410463

(51) Int. Cl.
*H04R 25/00* (2006.01)

(52) U.S. Cl. ..... 381/313; 381/356

(58) Field of Classification Search ..... 381/170, 381/312, 313, 320, 322, 324, 35, 356, 359, 381/360, 361, 364, 369; 181/144, 145, 147, 181/153

See application file for complete search history.

(56) References Cited

U.S. PATENT DOCUMENTS

| | | | | |
|---|---|---|---|---|
| 2,643,729 | A | 6/1953 | McCracken | |
| 4,836,326 | A * | 6/1989 | Wehner | 181/144 |
| 4,870,688 | A | 9/1989 | Voroba et al. | |
| 5,666,433 | A * | 9/1997 | Wehner | 381/361 |
| 6,567,526 | B1 | 5/2003 | Killion et al. | |
| 6,584,207 | B1 | 6/2003 | Yoest et al. | |

FOREIGN PATENT DOCUMENTS

| | | |
|---|---|---|
| DE | 2323437 | 11/1974 |
| DE | 2637305 | 3/1977 |
| GB | 2004439 A | 3/1979 |

* cited by examiner

*Primary Examiner*—Brian Ensey
(74) *Attorney, Agent, or Firm*—Adrian D. Battison; Ade & Company Inc.

(57) ABSTRACT

The device is now a squarely-truncated horizontal cylinder capped at each end by a circular disc central to which is placed a transducer. With amplification the device yields the sound spectrum which can be heard in consciousness. The cylinder is extended just sufficiently to accommodate truncation at 35 degrees 16 minutes yielding a chiral pair of elliptical openings which, with amplification, add cues to sound-source localization and range determination which are not heard but are known subconsciously. The long axes of the elliptical openings are set orthogonally at 45 degrees to the horizon, thus allowing correct spatial orientation. Elliptical caps, with open edges, are applied to the elliptical ends of the device hiding the transducers from view and from direct sound. To cancel internally generated resonances the enclosed spaces are filled with fine irregularly-shaped particulate matter.

21 Claims, 5 Drawing Sheets

MICROPHONE IN A CYLINDRICAL HOUSING HAVING ELLIPTICAL END FACES

The present invention relates to a precision microphone and to certain derivative applications of the microphone, particularly in the form of hearing aids.

BACKGROUND OF THE INVENTION

The applicant's Canadian patent no: 2,076,288, discloses a microphone for recording sounds, including directional and range information in the sounds.

The present invention incorporates certain improvements in the microphone design and applies the microphone to hearing devices, especially for the hearing-impaired.

SUMMARY OF THE INVENTION

According to one aspect of the present invention there is provided a microphone comprising:

a hollow cylindrical housing with a lateral axis, and having two non-parallel elliptical end faces oriented mirror symmetrically with respect to a plane perpendicular to the lateral axis;

two circular transducer mounting plates extending across the housing, adjacent the respective end faces, substantially perpendicular to the lateral axis;

two microphone transducers mounted centrally in respective ones of the transducer mounting plates for receiving sound from outside the transducer mounting plates;

end panels of air-pervious material extending across and closing the respective end faces;

two sound damping tragus pads secured to inner faces of respective ones of the end panels, each tragus pad having an elliptical periphery spaced from the housing.

end panels of an air-pervious material extending across and closing the respective end faces;

The microphone, in its preferred form, is referred to herein as the 'precision microphone'.

In use, the precision microphone is normally positioned with the lateral axis horizontal and the long axes of the two elliptical end faces converging downwardly to a front side of the microphone to meet at a dihedral angle of 70 degrees 32 minutes. These end faces are identified as 'right' and 'left' end faces.

This arrangement, through the use of a circular transducer mounting plate and an elliptical sound access to the microphone provides an analog to the elliptical to circular transition that is found in the human hearing system.

The outer circumferential edge of each mounting plate is preferably tangent to the inner circumferential edge of the adjacent end face of the housing, at the point where the axial distance between the end faces is a minimum.

The tragus pad provides a functional analog to the external ear of the human hearing system and serves to damp predominantly left-right mid-frequency sound information arriving at the microphone along the lateral axis where the transducer sensitivity is greatest. This yields a better balance of all the sound information.

These modifications correct certain anomalies that have been observed when recording under particular conditions with the prior design.

The currently preferred tragus pad comprises two air-impervious membranes secured together along the elliptical periphery, a stiffening material between the membranes, and a viscous fluid in the space between the membranes. It also includes a small circular port on the lateral axis.

A particulate material may fill the housing between each transducer mounting plate and the adjacent tragus pad to obviate distortion due to reflection in this part of the housing. The preferred particulate material is a sound damping material, for example powdered cork. It may be is coated with a viscous liquid, for example mineral oil.

The microphone may be ported by an aperture communicating the interior of the housing between the transducer mounting plates with the exterior of the housing. This is desirably a slit extending along the housing, between the mounting plates at the shortest length of the housing. This renders the housing, otherwise a column subject to resonance, aperiodic. A sound damping material, preferably a particulate material, for example oiled, crushed cork, preferably fills the housing between the end plates to damp other resonances.

The benefits of using directional microphones in hearing aids are known. Reference may be made, for example to Killion et al. U.S. Pat. No. 6,567,526 and the literature referenced in that patent. The microphone of the present invention may be adapted to this purpose for either external or in-the-ear applications.

Thus, according to another aspect of the present invention there is provided a hearing aid comprising;

a cylindrical housing with a lateral axis and having non-parallel elliptical end faces oriented mirror-symmetrically with respect to a plane perpendicular to the lateral axis;

two microphone transducers mounted in the housing to receive sound from the respective end faces;

a housing mount for mounting the housing on an eyeglass frame such that when worn, the lateral axis is substantially horizontal and the elliptical end faces converge forwardly and downwardly;

amplifiers coupled to the respective microphone transducers for receiving transducer signals therefrom;

ear pieces including respective earphone transducers connected to the amplifiers for receiving amplified transducer signals and converting the signals into sounds.

This provides a hearing aid incorporating an embodiment of the microphone that may be mounted on a frame for eyeglasses in order to receive and transmit to the wearer not only the ambient sounds but also the directional and range information contained within the ambient sound field so as to improve the signal to noise discrimination of the hearing aid.

According to a third aspect of the present invention there is provided a hearing aid comprising:

a cylindrical housing with a lateral axis and an elliptical end face;

a microphone transducer mounted in the housing to receive sound from the elliptical end face;

an amplifier for receiving electrical signals from the microphone transducer and amplifying the signals;

an earphone transducer for receiving amplified signals from the amplifier and converting the amplified signals into sound waves;

an earpiece for mounting the housing on a human ear with the lateral axis substantially horizontal and long axis of the elliptical end face sloping downwardly to the front.

According to this aspect, for the hearing assist is divided and may be located on or adjacent to the lateral zero axis of the human head, thus providing a more accurate representation of the surrounding sound field. This aspect of the invention is particularly suited for use as an in-the-ear hearing aid.

Another aspect of the invention is an improved loudspeaker system, referred to herein as the 'precision loudspeaker'.

BRIEF DESCRIPTION OF THE DRAWINGS

In the accompanying drawings, which illustrate exemplary embodiments of the present invention.

DETAILED DESCRIPTION

Figure 1:
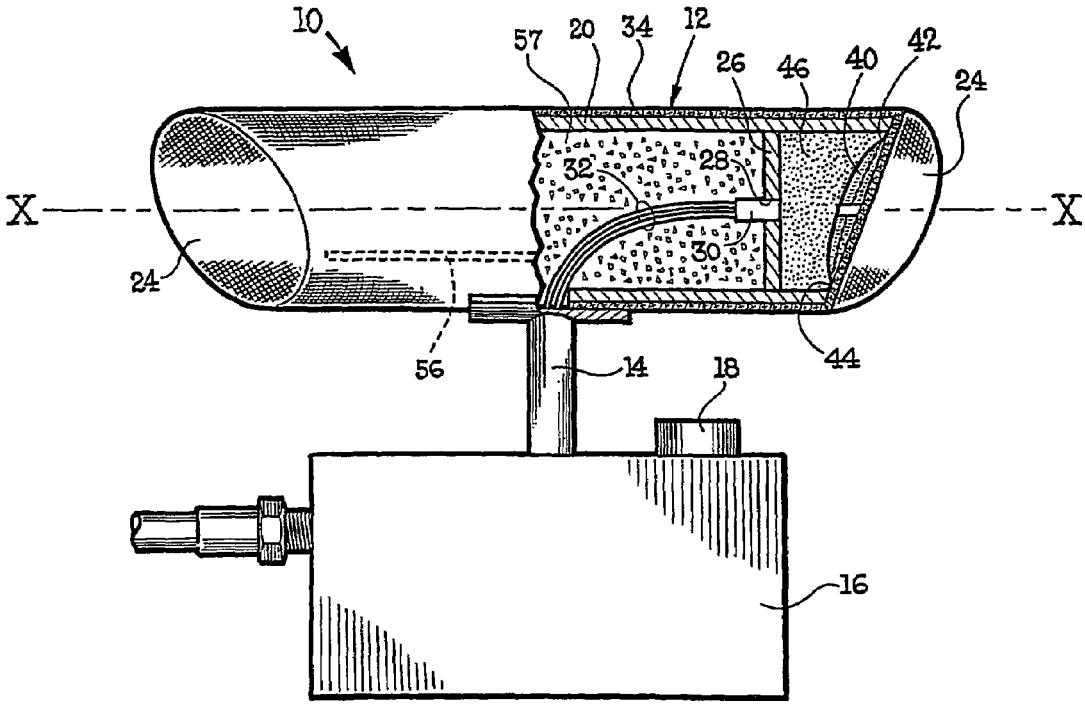
FIG. 1 is an elevation, partly in cross section, of a microphone according to the present invention.
Figure 2:
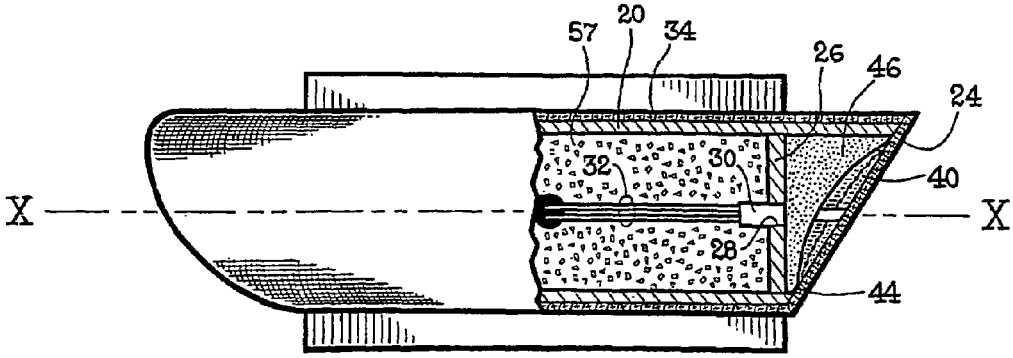
FIG. 2 is a top view of the microphone.
Figure 3:
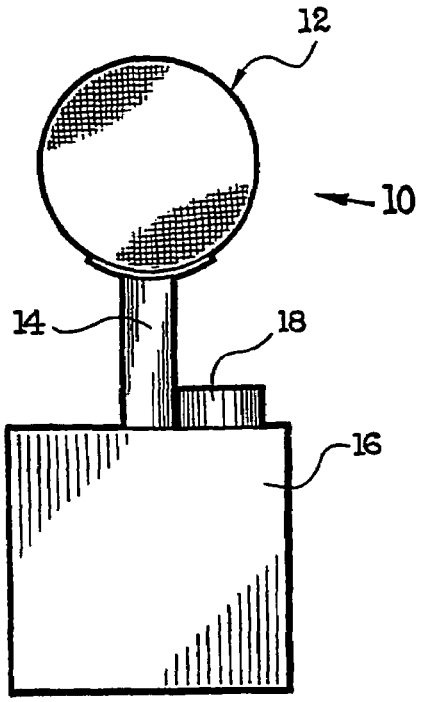
FIG. 3 is an end view of the microphone.
Figure 4:
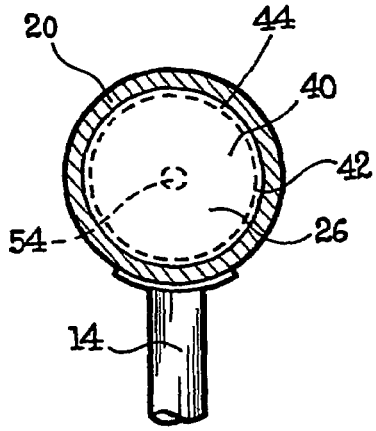
FIG. 4 is an end view like FIG. 2 showing the tragus pad in broken line

Referring to the accompanying drawings, and particularly to FIGS. 1 through 6, there is illustrated a microphone 10 having a housing 12 supported by a standard 14 on a base 16. The base is equipped with a spirit level 18 so that the microphone can be properly leveled for use.

The microphone housing has a cylindrical sidewall 20 with a longitudinal axis X-X and elliptical ends 24 that slope downwardly and inwardly towards the front in planes oriented at 35° 16' to the longitudinal axis to intersect at the dihedral angle of a regular tetrahedron (70° 32'). The long axis of each end face is oriented at an angle of 45° to the horizontal.

At each end of the housing is a transducer mounting plate 26 extending across the housing perpendicular to the axis X-X. The outer face of the mounting plate is flush with the innermost point on the end 24.

Each mounting plate 26 has a central bore 28 accommodating a microphone transducer 30. The electric leads 32 from the transducer run through the standard 14 into the base 16.

The microphone housing is covered with an appropriate fabric material 34 that is acoustically transparent, at least where it covers the open ends of the housing.

Secured to the inner face of the fabric covering where it extends across the housing end is a sound damping tragus pad 40 (FIGS. 4, 5 and 6) having an elliptical periphery 42 spaced from the inner surface of the housing side wall, leaving an unobstructed elliptical gap 44 around the tragus pad. The chamber between the tragus pad 40 and the mounting plate 26 is filled with a particulate sound damping material 46, for example ground cork, which is coated with a viscous liquid, for example mineral oil.

Figure 5:
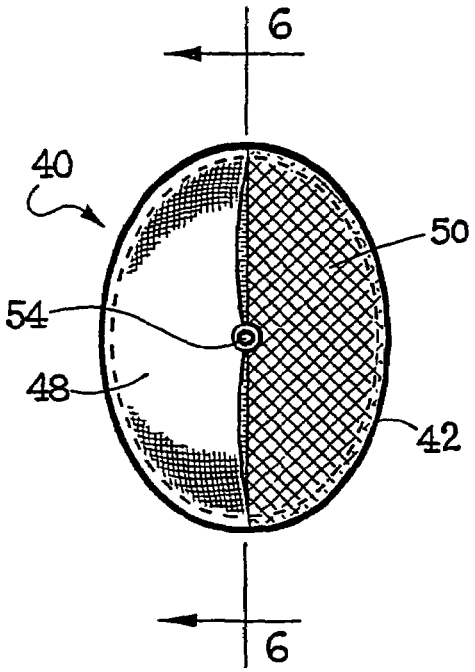
FIG. 5 is a broken away view of the tragus pad, showing the internal structure.
Figure 6:
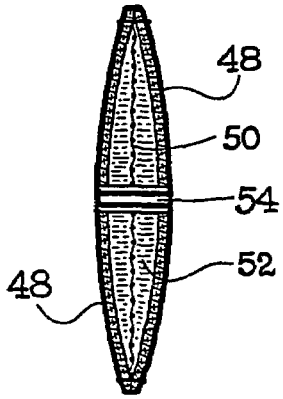
FIG. 6 is a section along line 6-6 of FIG. 5.

FIGS. 5 and 6 illustrate the construction of an exemplary tragus pad. The pad has an envelope formed from two membranes 48 of garden cloth secured together along the elliptical periphery 42. A stiffening material 50 is placed between the membranes. In this exemplary embodiment this is a stiff net or mesh. A viscous fluid 52, in this embodiment mineral oil fills the space between the membranes. The tragus pad has a small circular through port 54 on the lateral axis X-X of the housing.

To prevent resonance within the housing 12, the hollow center of the housing is ported by an aperture comprising a horizontal slit 56 extending from end to end of the housing, at the position of shortest axial length, and ending just inside the mounting plates 26. Between the end plates 26, the housing is filled with oiled, crushed cork 57 to damp other resonances.

Figure 7:
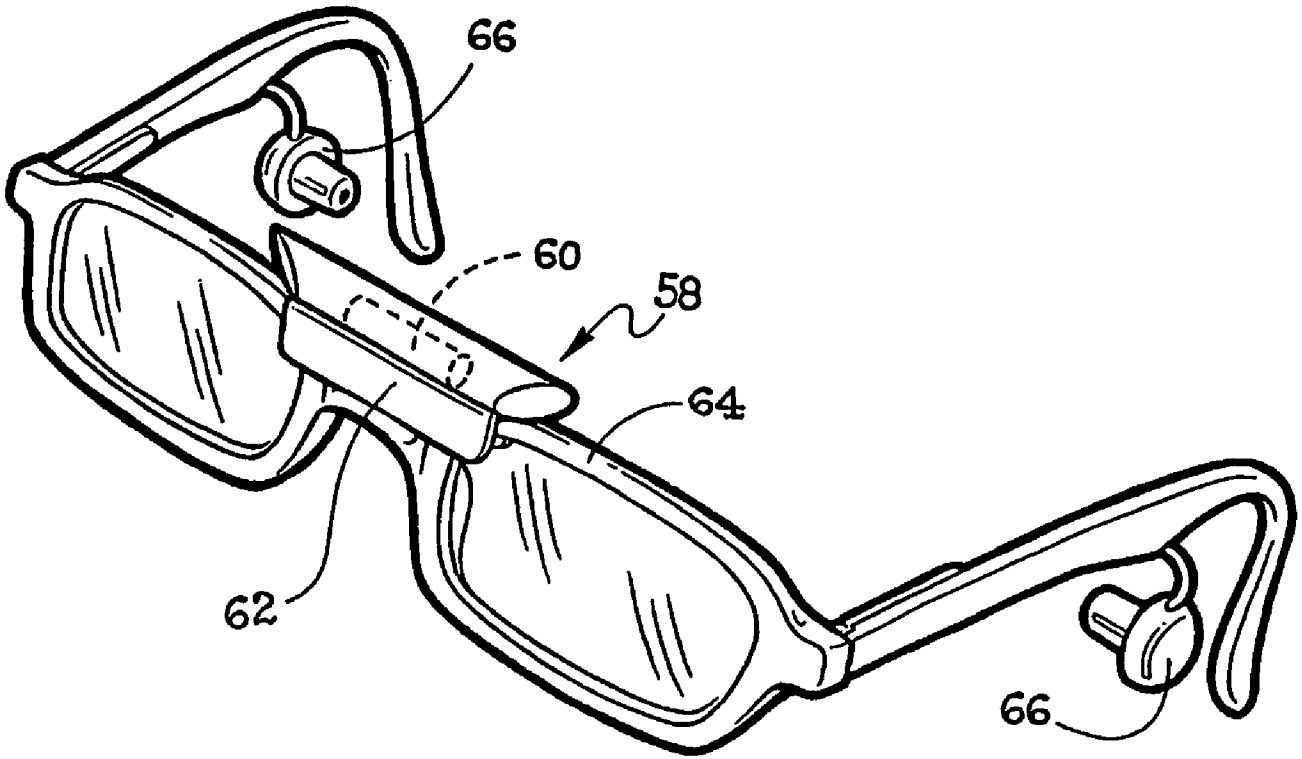
FIG. 7 is an isometric view of an embodiment of hearing assist mounted on an eyeglass frame.

FIG. 7 illustrates an embodiment of the microphone applied in an external hearing assist or aid. This microphone 58 is a miniaturized version of that described above, with an internal, two channel amplifier 60. The housing carries a mounting clip 62 for mounting the microphone on an eyeglass frame 64 such that when worn, and with the wearer's head upright with the eyes focussed on the horizon, the lateral axis of the microphone housing is substantially horizontal and the elliptical end faces converge forwardly and downwardly. The left and right outputs from the amplifier are connected to the earphone transducers of respective bud earpieces 66 to deliver amplified sound, including the desired directional and range information to the user.

Figure 9:
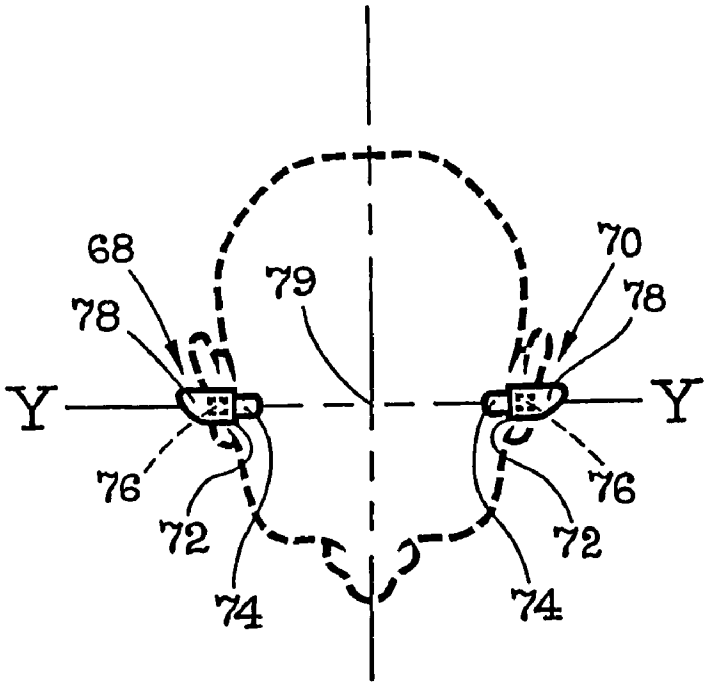
FIG. 9 is a top view of the second embodiment of hearing assist.
Figure 8:
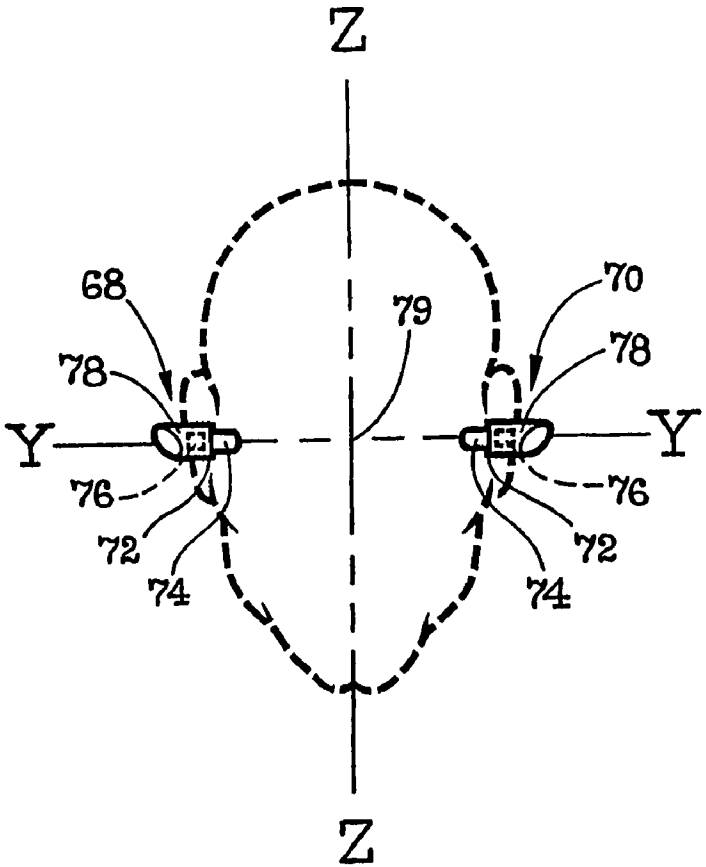
FIG. 8 is a front elevation of a second embodiment of hearing assist.

FIGS. 8 and 9 illustrate another embodiment of the microphone applied as an in-the-ear hearing assist or aid. In this case, the microphone is physically separated into right and left hand elements 68 and 70 respectively, that are allochiral or mirror-symmetrical. Each component has an earpiece 72 moulded to fit the ear of a user. The microphone element is embedded in the earpiece along with an amplifier 74 and an earphone transducer 76. The microphone element has a cylindrical housing 78 and is constructed in the same way as one end of the microphone of FIGS. 1 through 4. The microphone transducer is the input source to the amplifier 74 which drives the earphone transducer 76. When worn, the axis of each component is at least generally aligned with the lateral, horizontal tilt axis Y-Y of the head, to pass through the "zero point" 79 where the tilt axis intersects the vertical rotation axis Z-Z of the head.

Figure 10:
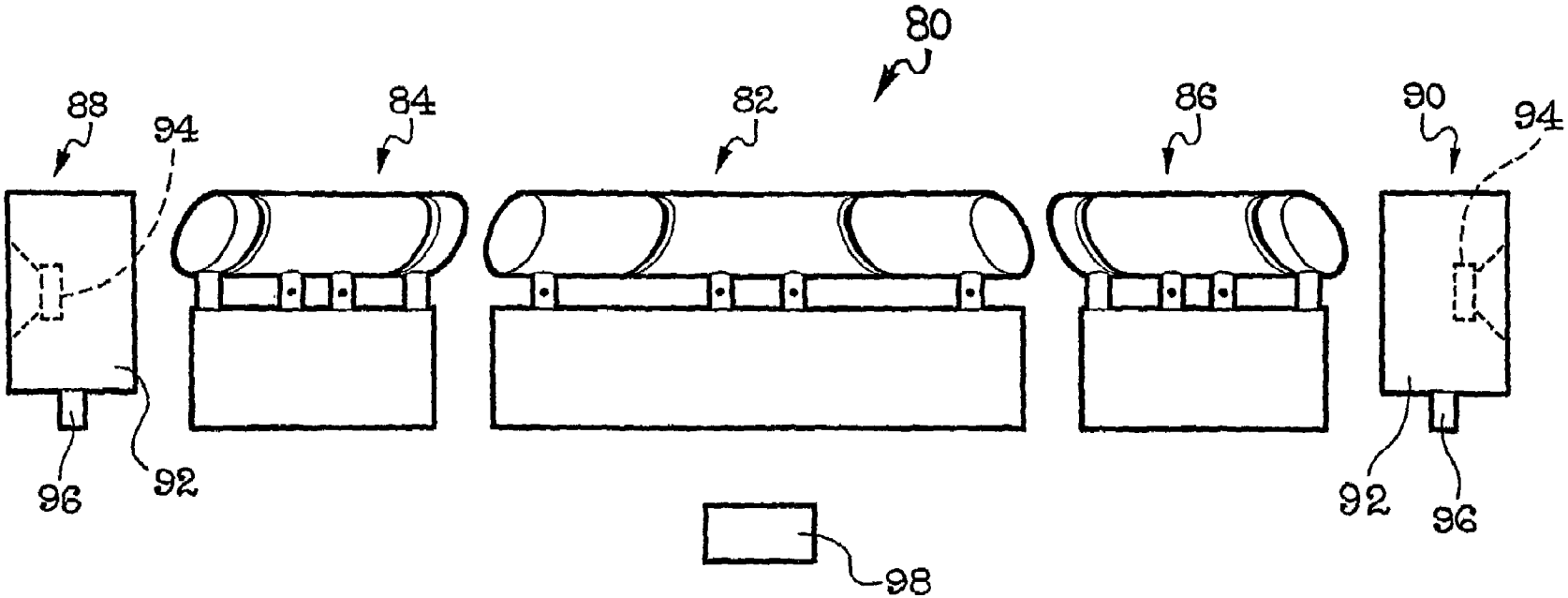
FIG. 10 is a front elevation of a modified loudspeaker system.

FIG. 10 illustrates a loudspeaker and components of the loudspeaker intended for use in reproducing sound recorded using the microphone 10. The loudspeaker 80 has a center unit 82, a left end unit 84 and right end unit 86. The three units are all configured and arranged as described in the applicant's Canadian patent 2,076,288. In this system, two additional components 88 and 90 are added at opposite ends. Each of the additional components includes a speaker enclosure 92 housing a low to mid-range speaker 94, radiating outwardly (see "O. Sound Envelopes" in "THEORETICAL CONSIDERATIONS" (infra)). The enclosure is ported by ports 96 on the bottom below. The additional left and right speakers are driven by left and right amplifier outputs respectively through a crossover 98 operating at approximately 400 Hz.

The enclosures 86 are filled with light weight, fractal-like bodies, e.g. oiled popcorn to render the enclosures aperiodic to eliminate colour.

Theoretical Considerations

In consideration of and further to the theoretical considerations presented in the applicant's Canadian patents 1,060,350, issued 14 Aug. 1979; 1,282,711, issued 9 Apr. 1991; and 2,076,288, issued 30 Jan. 2001 (U.S. Pat. Nos. 4,122,910; 4,591,343 and 5,666,433) the entire disclosures of which are incorporated herein by reference, the following considerations form the basis of the further developments described and claimed herein:

A. Towards a Tetrahedral Theory of Sound Source Localization and Range Determination The following postulates are the basis of the current theory on which the present invention is based:

1. Sound source localization is an active process whereby human cochleae simultaneously encode sound source identification, range and localization information.

2. In free field situations, evoked otoacoustic emissions yield bands or curves which comprise a primary band relevant to sound source identification and range determination together with secondary sidebands of slightly higher and slightly lower frequency relevant to sound source localization, e.g. 1000 Hz, 960 Hz, 1040 Hz.

3. Identification, range determination and sound source localization information is transferred centrally by the right and left auditory nerves. A unitary image is constructed about a central zero-point and heard by 'mind' wherein it may be consciously attended and the range and sound source localization may be intentionally known.

4. Throughout its length four rows of hair cells are situated on the basilar membrane, with the following characteristics:

a. Row 1: This inner row of hair cells is comprised of receptors which synapse with the auditory nerve to deliver afferent impulses.

b. Rows 2, 3, 4: Actively tune the basilar membrane to yield the primary band and sidebands relevant to sound source localization information.

c. Row 3: Actively tunes the basilar membrane to yield the primary, central band relevant to sound source identification and its range determination.

d. Rows 2, 3, 4: Are the outer hair cells innervated by efferent fibres of the auditory nerve?

5. Sidebands result from wave-interference of the head shape and are compared centrally with the platonic form of a regular tetrahedron set in an orthogonal position as the geometric frame of reference.

6. Sidebands are the resultant of Doppler-like shifts determined by shape of the head which creates a sound 'shadow'.

7. While the duplex theory of sound source localization has served well for the understanding of two-dimensional horizontal planar space, it is incomplete. The geometry of the vestibular apparatus suggests a tetrahedral-octahedral four-dimensional reference frame that accommodates, in all directions about a precise point, sound source range determination and localization information. A virtual center for precision space-time located midway between the tympani is proposed and the orthogonally-placed regular tetrahedron about that center serves as the virtual template for central comparison and peripheral adjustment whereby, no matter what changes in size and shape of the head and body over time, the individual maintains a capacity for precision space-time orientation. As observed in the barn owl, recent studies suggest gating of instructive error signals to be the mechanism for this. (Marcia Barinaga: "Sight, Sound Converge in Owl's Mental Map" SCIENCE Vol. 297, 30 Aug. 2002, pp. 1462-3 and Yoram Guffreund, Weimin Zheng, Eric I. Knudsen: "Gated Visual Input to the Central Auditory System" SCIENCE Vol. 297, 30 Aug. 2002, pp. 1556-9)

Superior Olivary Complex

For approximately fifty years it has been anticipated that the superior olivary complex of the brainstem, the first brain region innervated by the two ears, would yield an azimuthal topographic map of auditory space where the neurons are responsive to interaural time difference (ITD). That idea is now open to question and the discovery of glycine-controlled inhibition raises new possibilities. Congruent with the tetrahedral theory of sound source localization is the idea of a topographical map of auditory space where the neurons are responsive to interaural frequency difference (IFD). Thus the functional significance of glycine-controlled inhibition arising from the medial nuclear trapezoid body innervation (MNTB) may be to maintain a virtual multispheric concentric topographical map of auditory space relating to sound source localization and relative range determination. In this interpretation interaural level difference (ILD) becomes highly significant in its determining whether the sound source is to the right or the left of the organism.

Based on experience with the 'precision microphone' and the 'precision loudspeaker' which, taken together, are a working model of the human hearing system, the virtual topographic map is comprised of a series of concentric spheres whereby an event related potential (ERP) is mapped onto that sphere whose radius demonstrates relative range along a proximal-distal axis. The medial olivary complex is challenged by Interaural frequency difference (IFD) which is a product of Doppler-like shifts in the frequency of an identifier resulting from head shape. Further central processing leads to the potential for conscious identification of the sound source by humans together with the potential for knowing, with intent, both the range and the location of that source, while the map of concentric circles may begin to explain the experience of externalization whereby the sound source is perceived to be 'out there'. (George D. Pollak: "Model Hearing" NATURE Vol. 417, May 2002 and Antje Brand, Oliver Behrend, Torsten Marquardt, David McAlpine and Benedict Grothe: "Precise Inhibition is Essential for Microsecond Interaural Time Difference Coding" NATURE Vol. 417, 30 May 2002)

8. A four-dimensional description of reality, where 'dimension' is considered to simply be a perpendicular to a plane, is essentially tetrahedral. This lends itself to observer-dependent experience of space-time (Minkowski, Einstein), and is the basis of the 'precision microphone' which is intended to be essentially biological and, potentially, a key to a deeper understanding of human hearing. As a tetrahedron is conceptual and independent of size, its derivative, the 'precision microphone' is likewise conceptual and independent of size. Ultimately, its deployment at nanoscale may yield new and interesting facets of the quantum domain.

The 'precision microphone' may also be considered a multidimensional microphone gathering information from a multiple, or 'n', dimensions. If 'dimension' means a perpendicular to a plane and if in physical reality a geodesic sphere is simply a polyhedron of high frequency with many planes, then a dimension is simply the line connecting the center of one of the small triangles on the periphery to the center of the sphere, and passing through the center (zero point) will emerge 180° in the center of another small triangle. It should not be surprising then, if that small triangle appears to be completely and polarly opposite by its location and its 180° rotation from the first. And there may be many dimensions, depending on the frequency of the geodesic sphere. A regular tetrahedron may be considered the polyhedron of least frequency.

Another polyhedron, icosahedron expanded to frequency 'n', may elegantly serve as a computer-generated spherical map of localization and, in this form, the geometric principles of the 'precision microphone' may ultimately serve as a navigational aid.

9. Theoretically, 'precision microphone' orthogonally-placed in identical space-time of a human listener, is expected to yield identical primary and sideband information, and if the 'precision microphone' authentically represents a virtual tetrahedron orthogonally-placed about a virtual reference point (zero point) located midway between the tympani, its right and left channel information should authentically represent the identifier together with sound source localization and range determination information of human hearing.

B. An Approach to Resolving Ambiguities

Comprehensive anticipatory design science (CADS) used in the development of the 'precision microphone' began by asking: "what is it that we hear?" and then asking: "how does that happen?", followed by "what structures are involved?" and then "what is their shape?" and the process moved from the whole to the particular.

To the degree that the tetrahedral theory is complete there is potential for understanding and management of ambiguities. For example, because of the forward and slightly upward direction of the auditory canal together with the pinna and overlying tragus, no direct sound reaches the tympanum. By design, the tragus pads provide that in the case of the 'precision microphone', no direct sound reaches the transducer excepting through a narrow horizontal canal which gives the pad a toroidal character. Accessing event related potentials through a very small aperture significantly limits the so-called 'cone of confusion'. In the design of the 'precision loudspeaker', which simultaneously yields ten event related potentials, there is, also, no direct sound reaching the listener.

In the human, saccadic movements about the vertical rotational axis further resolve ambiguity such that with a slight shift to the left, sound impinging anteriorly on the right of the cone will move further to the right while sound impinging posteriorly on the right of the zone will move further to the left.

C. Current Practices

The placing of miniature microphones in the ear canals of living subjects or experimental models, e.g. Kemar—"Knowles Electronic Manikin for Acoustic Research", probably yields less than authentic information because of unavoidable physical limitations:

"The acoustic environment created by the ear canal and ear drum is one that 3D sound synthesis strives to simulate. HRTF generation uses small microphones embedded in a real ear canal to help simulate the real acoustic environment. The use of a small microphone in the ear canal can only approximate the real thing: frequency response is different, position is different, reflection and refraction of sound waves are different".

D. Selective Auditory Attention

It is hypothesized that:

Row 3 (supra) yields the primary band and encodes the identifier in auditory scene analysis and is available for full conscious attention as it, specifically, is chosen by central filtering mechanisms;

Row 3 yields the primary band and encodes range information which may be intentionally known;

Rows 2, 3, 4 with rows 2 and 4 yielding the secondary bands, are the sound source localization of the identifier in auditory scene analysis and may be intentionally known.

For depiction of primary and secondary bands refer to C. of page 7: Giard et al. Neurophysiological "Mechanisms of Auditory Selective Attention in Humans, Frontiers in Bioscience", v5, d84-94, 1 Jan. 2000

E. Functional Significance of the External Ear

When viewed from the side along the horizontal tilt axis of the head, the external ear appears elliptoid in shape yielding a long axis which points downward at approximately 45 degrees. Its virtual plane tips forward and downward approximating the virtual plane of the tympanum. The auditory canal, penetrating the structure inwardly, also renders it toroidal in shape. The tissues of the external ear are comprised of skin covered in part with fine hairs, cartilage which gives the characteristic flexible stiffness, and soft tissue comprised of cells with semi-liquid interiors and bathed in serum. Sound energy perturbs air molecules single-bondedly inter-attracted in maximum flexibility (Willard Gibbs: phase rules). With energetic perturbation, double and triple bonding of inter-attractive molecules in intracellular and extra cellular fluid and cartilaginous solid tissues, respectively, differentiate the effects of sound transmission and attenuation of external ear tissue. Thus the effect on incoming sound energy is complex.

F. Auditory Canal

The auditory canal is tilted upwards and forwards and is partially sheltered by the tragus pad of the outer appendage. Careful examination of the whole external ear reveals that there is no direct access to the tympanum of sound-related potentials. In 'precision microphone' the central small-bore horizontal tunnel of the tragus pad does not yield direct access to the transducer beyond because of the intervening particulate matter. The external ear canal has an approximate resonant frequency of 3400 Hz which is thought to be of importance for speech understanding. As the cavity medial to the tragus pad is designed to be aperiodic and relatively colourless, it permits a wide-band potential for speech understanding.

G. Oval Window and Round Window Niche

It is proposed that there is a functional significance to the oval to round reduction in the outline of the cochlear canal. Through the ossicular apparatus of the middle ear, the tympanum connects to the oval window of the inner ear which closes at one end the cochlear perilymph space which is then closed at its other end by the round window. This oval to round reduction through perilymph may parallel the elliptical to circular enfolding of information by the 'precision microphone' (multidimensional to unidimensional about a zero-point).

H. The Vestibular Labyrinth

The 'precision microphone' is based on a tetrahedral structure and suggests that we, as humans, are likewise configured, especially in relation to the vestibular apparatus which, in a single structure, connects our experience of sound, balance and motion. A small step takes us to the suggestion that our central nervous system architecture is octahedral and one final step suggests that vector equilibrium may be the architecture of mind and our connection to space-time. Octahedron and vector equilibrium derive step-wise and geometrically from the fundamental tetrahedron.

Our atmosphere attaches to earth and its individual molecules, while single-bonded in their relationships (Gibbs' phase rule), must also articulate in relationship to the surrounding sea of gravity. A simple conjecture, then, suggests that the complex organ devoted precision-wise to issues of balance and motion in the field of gravity also relates precision-wise to issues of sound transmitted through a highly-structured medium. If so, it becomes extremely important, then, that the 'precision microphone' and its derivative the 'precision loudspeaker' array, relate specifically to the gravitational field. This is accomplished by having the long axes of all of the elliptical faces set at 45° to the horizontal.

I. Outer Hair Cells

It is now generally accepted that outer hair cells relate to sensitivity and specificity of the cochlea. It is proposed that the functional significance of three rows of outer hair cells is their encoding not only of the identifier of an event related potential but also the encoding of simultaneously received information relating to sound source localization and range determination.

J. Selective Auditory Attention Research

Giard et al. (Giard et al., Frontiers in Bioscience, v5, d84-94, Jan. 1, 2000) show on page 7 a graph depicting Primary and Secondary Bands where 'Primary Band' represents consciously attended information. It is proposed that in the outer hair cells row 3 relates to the identifier in auditory scene analysis and is available for conscious consideration. Range information, received simultaneously, derives from row 3 and can be known. Rows 2, 3, 4 taken together, relate to sound source localization and, while yielding information simultaneously received, can be known but is not available for conscious consideration. Rows 2 and 4 are probably the generators of secondary band information.

K. Defining Zero Point and Applicability to Assistive Hearing Device

It is conjectured that for humans there is a single horizontal tilt axis articulating on the occipito-atlantic joint and which passes through the centers of the oval tympani or slightly higher through the centers of the oval windows of the inner ear. An approximate surface location is the small depression just antero-superior to the tragus on each side of the head. For microphone and loudspeakers the axis passes through the center of the oval openings and through the center of the structure. The vertical rotational axis of the head probably intersects the horizontal axis in the human except, possibly, in some psychopathological states (Feldenkrais-Feldenkrais, M: "Body and Mature Behavior" a Study of Anxiety, Sex, Gravitation and Learning", 1949, Madison Conn., International Universities Press, 163 pp). The intersection of horizontal and vertical rotation axes is referred to as zero-point which, in the equilibrious state, is the center of volume of regular tetrahedron. Articulation about a precise zero-point permits accurate determination of location of a sound source.

1. 'Precision microphone' is separated between the two elements to yield two equal parts that retain the basic 'twoness'.

2. Parts are attached to subject's head on each side slightly anterior and superior to the tragus along the horizontal tilt axis of the head and relating to zero point which is the intersection of the horizontal tilt axis with the vertical rotational axis.

3. Parts, while essentially identical in size and shape, are arranged to retain their original or chiral relationship, basic 'handedness' or mirror symmetry, namely ½ spin from exact congruence.

4. With the subject standing in the anatomical position with her/his gaze to the horizon the long axis of each ellipse will be 45° down from the horizontal to yield a correct relationship with earth's gravitational field.

5. By way of amplification right and left signals are transmitted to the respective right and left ear canals via sound insulating ear buds (speakers).

L. Tympanum

On each side the tympanum is oval in outline and its plane tilts both towards the center-front and down. It is conjectured that the right and left planes of the tympani are congruent with planes of a regular tetrahedron set orthogonally with one plane uppermost and horizontal. The 'precision microphone' is an abstraction of this and its two elliptical openings are thought to be congruent with the tympanic planes.

M. Doppler-Like Frequency Shifting

Reports in the literature (Semple, Malcolm N.: "Auditory perception: Sounds in a Virtual World", Nature 396, 721-724 (1988) and Kulkarni, Abhjit and Colburn, Steven H.: "Role of Spectral Detail in Sound Source Localization", Nature 396 747-749 (1988) suggest that our ability to externalize the experience of sound is determined by head-related transfer functions. Our experience is that 'precision microphone' consistently yields images that are externalized and localized spherically (720°) when heard over headsets without reference to filtering (relative boosting, attenuating and delaying of component frequencies) of incoming sound waves. Our analyses suggest that the invariantly proportioned shape of the 'precision microphone' yields Doppler-like frequency shifting (up and down) that may be algorithm-managed to produce precision determination of location and range, and a corollary hypothesis is that the planar congruence of tympanic ellipses with orthogonally-placed (in Earth's gravitational field) regular tetrahedral shape is the primary factor in human externalization and localization and, that there is also clear congruence with the planes of the semi-circular canals of the vestibular apparatus.

If these hypotheses hold with robust experimental testing we can expect widespread application of the principles.

N. Gravitational Field

The gravitational field is the one that becomes understood early in life, as infants learning to sit up and developing into the human organism with its maximum instability coupled to maximum flexibility of motion (Feldenkrais, supra). Gravity and its effects are monitored by the vestibular apparatus which includes the cochlear hearing organ relating to a spherical domain about a central point between the ears. 'Precision microphone' is a working model of the hearing system in its relationship to gravity, The rules of gravity were worked out by Newton in the seventeenth century.

O. Sound Envelopes

There are three levels of sound envelope, which relate to the structure of the human hearing system:

Level 1 envelope—low frequency sound, undifferentiated as to location and no reference to a central point.

Level 2 envelope—mid-frequency sound, differentiated as to location on a horizontal plane (azimuth) about a central or zero point. It gives basic right and left handedness and is the source of inter-aural time and intensity differences that feature in the duplex theory.

Level 3 envelope—high frequency sound, spherically differentiated about a central point (zero point) that features in the tetrahedral theory.

P. Optimal Shadow

By taking a single orlid (Orlid' refers to a cylinder cut perpendicular to the axis at one end and truncated at the other end at an angle of 30° 16'. Two orlids joined at their cross sections and with the long axes of both elliptical openings set at 45' to the horizontal constitute the body of 'precision microphone' in an orthogonal relationship to the horizon.) and placing it on a plain white surface with the right angle truncation down and placing it in coherent light such as that from the bright sun and then rotating it, an internal shadow moves in a cyclic fashion yielding a sinusoidal curve. A similar situation prevails when coherent (natural) sound information falls on the orlid. Another approach is to take the single orlid and wrap a sheet of white paper around it and then trace out the elliptical outline of the orlid onto the paper, an externally-derived sinusoidal curve appears. This can readily be done using a double orlid and the functional significance of the dynamics of localization begin to suggest themselves.

The shadow needs to be 'clean' and without ambiguity. In the 'precision microphone' there is a potential resonant ambiguity produced by the cavity interior to the tragus pad. The cavity can be made relatively aperiodic by filling the cavity with the lightly oiled fine cork particles (Gibbs' phase rules relating to solids, liquids, and gases are relevant to the inclusion of this material.).

Q. Orlid and the Doppler Effect

To demonstrate the Doppler effect of the orlid, embed a single microphone element at the center of the circular end of a cylindrical horizontal bar. Expose the microphone element to a single tone of known frequency. The event related potential will yield a band of similar frequency. Now cap the bar with an orlid such that the long axis of the elliptical face is 45° to the horizontal and repeat the procedure. The event related potential again yields a band of similar frequency (primary band) together with two side bands, one lower and one higher in frequency than the primary band and the frequency relationships of the side bands will vary as the vectorial angle of incidence of the single tone varies. FIGS. 15-16 of Canadian patent 2,076,288, issued Jan. 30, 2001, illustrate these effects.

R. Sound Fields are Seamless

Event related potentials taken from a specific space-time location (zero point) simply fade away while amplification extends the range. Unlike visually perceived or felt objects, auditory objects have no boundaries and are manifestations in a seamless universe. An individual's sound field is a portable, personal and unique abstraction seamlessly derived from a larger whole. And when a recording is made with the 'precision microphone', an individual is free to return to a unique location in space-time to explore again many corners of the sound field with or without the psycho-physiological filters accumulated over a lifetime. The listener has central control then, over selective auditory attention.

S. The Unitary Experience of Listening

"Unity is Plural and a Minimum of Two" (Fuller)

"Two Descriptions Are Better Than One" (Bateson)

It is assumed that in our hearing, information ("Difference That Makes a Difference"—Bateson) at the left ear is different than that at the right ear and, initiated by Lord Rayleigh, this has been the basis for research respecting sound source localization over the past 100 years. The language has been that of head related transfer functions or HRTF'S derived from interaural time and intensity differences.

But, our experience is unitary, that is, we hear single auditory objects, not single objects twice as might be expected, and is sometimes the case in stereophonic representation of events. (There is the case, however, of the person having experienced a catastrophic brainstem lesion who does have 'stereo' hearing with sound on the left and sound on the right without the unitary experience.) Unlike stereo, the 'precision microphone' gives a unitary experience if the associative neural pathways are intact.

Also, because the 'precision loudspeaker' has a parallel associative network, it yields a unitary image that fills all space with no apparent dead spots, and, as is the case with listening in a real sound field, there is an integrity of the relationship between the listener and the image. As the listener moves about there may be the uncanny sense of an image unwilling to let go.

The simultaneous encoding of not only the identifier but also sound source localization and range determination information about a specific zero point, the image, as heard over a headset, is akin to being surrounded 'out there' with the externalization of the experience and, as well, giving a sense of being 'in-the-sound'.

When program material from the 'precision microphone' is delivered as ten separate event related potentials by the 'precision loudspeaker', an identical image is reconstructed about the zero point of the loudspeaker array such that the listener, sitting behind and sharing a right-left orientation, may find himself or herself literally "in the sound".

T. Proposed Definitions

When an individual listens, what is it that hears?

Epistemological issues deriving from polarized perspectives such as material realism, on the one hand, and monistic idealism, on the other, sooner or later come into play when we begin to consider the physics of subjective experience. It is likely that tetrahedral theory will interest scientists and philosophers across the epistemological spectrum. Consider, then, it reasonable to set out definitions that may be tentative but have heuristic value. (Goswami, Amit: "The Self-Aware Universe: How Consciousness Creates the Material World", 1993, New York, Penguin Putnam Inc. 274 pp.)

"SOUND EXPERIENCES" are mental phenomena that relate directly to physical events, sound field recordings made with the 'precision microphone' and heard over headset, memories, imaginations, dreams, hallucinations, mystical experiences, etc.

"EVENT RELATED POTENTIALS" are perturbations in the atmosphere, vibrations of the ossicular apparatus of the middle ear, evoked otoacoustic emissions, acoustic nerve depolarizations and repolarizations, related brain activities, etc.

While specific embodiments of the invention have been described in the foregoing, it is to be understood that other embodiments are possible without departing from the spirit and scope of the invention. Thus, for example the air impervious membranes of the tragus pads may be a single impervious envelope, for example a paraffin wax coating or the equivalent. In addition, while external, eyeglass mounted and in-the-ear embodiments of the hearing aid application are disclosed, the invention is readily adapted to other forms of hearing aid, including the behind-the-ear format.

The invention claimed is:

1. A microphone comprising:

a hollow cylindrical housing with a lateral axis, and having two non-parallel elliptical end faces oriented mirror symmetrically with respect to a plane perpendicular to the lateral axis;

two circular transducer mounting plates extending across the housing, adjacent the respective end faces, substantially perpendicular to the lateral axis;

two microphone transducers mounted centrally in respective ones of the transducer mounting plates for receiving sound from outside the transducer mounting plates;

end panels of air-pervious material extending across and closing the respective end faces;

two sound damping tragus pads secured to inner faces of respective ones of the end panels, each tragus pad having an elliptical periphery spaced from the housing.

2. A hearing aid comprising:

a cylindrical housing with a lateral axis and having non-parallel elliptical end faces oriented mirror-symmetrically with respect to a plane perpendicular to the lateral axis;

two microphone transducers mounted in the housing to receive sound from the respective end faces;

a housing mount for mounting the housing on an eyeglass frame such that when worn, the lateral axis is substantially horizontal and the elliptical end faces converge forwardly and downwardly;

amplifiers coupled to the respective microphone transducers for receiving transducer signals therefrom;

earpieces including respective earphone transducers connected to the amplifiers for receiving amplified transducer signals and converting the signals into sounds.

3. A hearing aid comprising:

a cylindrical housing with a lateral axis and an elliptical end face;

a microphone transducer mounted in the housing to receive sound from the elliptical end face;

an amplifier for receiving electrical signals from the microphone transducer and amplifying the signals;

an earphone transducer for receiving amplified signals from the amplifier and converting the amplified signals into sound waves;

an earpiece for mounting the housing on a human ear with the lateral axis substantially horizontal and long axis of the elliptical end face sloping downwardly to the front.

4. A hearing aid according to claim 2 including a circular transducer mounting plate extending across the housing, adjacent the elliptical end face, substantially perpendicular to the lateral axis, the microphone transducer being mounted centrally in the transducer mounting plate for receiving sound from outside the transducer mounting plate.

5. A hearing aid according to claim 4 including an end panel of air pervious material extending across and closing the end face of the housing.

6. A hearing aid according to claim 5 including a sound damping tragus pad secured to an inner face of the end panel, the tragus pad having an elliptical periphery spaced from the housing.

7. A hearing aid according to claim 6 wherein the tragus pad comprises two membranes secured together along the elliptical periphery, a stiffening material between the membranes, and a viscous fluid in the space between the membranes.

8. A hearing aid according to claim 7 wherein the tragus pad includes a circular port on the lateral axis.

9. A hearing aid according to claim 6 including particulate material filling the housing between the transducer mounting plate and the tragus pad.

10. A hearing aid according to claim 9 wherein the particulate material is a sound damping material.

11. A hearing aid according to claim 3 including a circular transducer mounting plate extending across the housing, adjacent the elliptical end face, substantially perpendicular to the lateral axis, the microphone transducer being mounted centrally in the transducer mounting plate for receiving sound from outside the transducer mounting plate.

12. A hearing aid according to claim 11 including an end panel of air pervious material extending across and closing the end face of the housing.

13. A hearing aid according to claim 12 including a sound damping tragus pad secured to an inner face of the end panel, the tragus pad having an elliptical periphery spaced from the housing.

14. A hearing aid according to claim 13 wherein the tragus pad comprises two membranes secured together along the elliptical periphery, a stiffening material between the membranes, and a viscous fluid in the space between the membranes.

15. A hearing aid according to claim 14 wherein the tragus pad includes a circular port on the lateral axis.

16. A hearing aid according to claim 13 including particulate material filling the housing between the transducer mounting plate and the tragus pad.

17. A hearing aid according to claim 16 wherein the particulate material is a sound damping material.

18. A microphone according to claim 1 wherein the tragus pad comprises two membranes secured together along the elliptical periphery, a stiffening material between the membranes, and a viscous fluid in the space between the membranes.

19. A microphone according to claim 18 wherein the tragus pad includes a circular port on the lateral axis.

20. A microphone according to claim 1 including particulate material filling the housing between the transducer mounting plate and the tragus pad.

21. A microphone according to claim 20 wherein the particulate material is a sound damping material.

* * * * *